US009119000B2

(12) United States Patent
Tracy

(10) Patent No.: US 9,119,000 B2
(45) **Date of Patent: *Aug. 25, 2015**

(54) MODULAR SPEAKER SYSTEM

(76) Inventor: Dennis A. Tracy, Culver City, CA (US)

( * ) Notice: Subject to any disclaimer, the term of this patent is extended or adjusted under 35 U.S.C. 154(b) by 800 days.

This patent is subject to a terminal disclaimer.

(21) Appl. No.: 13/415,215

(22) Filed: Mar. 8, 2012

(65) Prior Publication Data

US 2012/0183158 A1 Jul. 19, 2012

Related U.S. Application Data

(63) Continuation-in-part of application No. 12/109,822, filed on Apr. 25, 2008, now Pat. No. 8,165,333.

(60) Provisional application No. 60/907,968, filed on Apr. 25, 2007.

(51) Int. Cl.

| | |
|---|---|
| ***H04R 1/02*** | (2006.01) |
| ***H04R 1/26*** | (2006.01) |
| *H04R 5/02* | (2006.01) |
| *H04R 27/00* | (2006.01) |

(52) U.S. Cl.

CPC .. *H04R 1/26* (2013.01); *H04R 5/02* (2013.01); *H04R 27/00* (2013.01); *H04R 2201/028* (2013.01); *H04R 2205/022* (2013.01)

(58) Field of Classification Search

CPC ..... H04R 1/02; H04R 1/28; H04R 1/00; H04R 2205/022; H04R 2201/401; H04R 2201/405; H04R 1/025; H04R 1/026

USPC ..... 381/332–336, 345, 182, 386–390, 395, 381/124

See application file for complete search history.

(56) References Cited

U.S. PATENT DOCUMENTS

| | | | |
|---|---|---|---|
| 3,052,758 | A | 9/1962 | Berry |
| 4,042,778 | A | 8/1977 | Clinton |
| 4,139,731 | A | 2/1979 | Hashemi et al. |
| 4,190,738 | A | 2/1980 | Samuels |
| 4,199,657 | A | 4/1980 | Lane |
| 4,475,226 | A | 10/1984 | Greenberg |
| 4,757,544 | A | 7/1988 | Guy |
| 4,882,760 | A | 11/1989 | Yee |
| 4,953,223 | A | 8/1990 | Householder |
| 5,000,826 | A | 3/1991 | Kitano |
| 5,146,508 | A | 9/1992 | Bader et al. |
| 5,546,468 | A | 8/1996 | Beard |

(Continued)

*Primary Examiner* — Suhan Ni

(74) *Attorney, Agent, or Firm* — Welsh Flaxman & Gitler LLC

(57) ABSTRACT

A modular speaker system includes a base assembly having a longitudinally extending, central support member and a support leg extending therefrom in a manner supporting the central support member in a generally upright configuration. The central support member includes a first end and a second end. A first woofer is secured to the base assembly, and a base assembly amplifier is mounted within the central support member and connected to the first woofer. An auxiliary speaker assembly includes a longitudinally extending, auxiliary support member having a first end and a second end, the first end being shaped and dimensioned for selective engagement with the second end of the central support member. A first driver is secured to the auxiliary speaker assembly and an amplifier is mounted within the auxiliary support member and is connected to the first driver.

19 Claims, 6 Drawing Sheets

(56) References Cited

U.S. PATENT DOCUMENTS

| | | | |
|---|---|---|---|
| 5,677,669 | A | 10/1997 | Walkley, IV et al. |
| 5,743,728 | A | 4/1998 | Cloud et al. |
| 5,802,194 | A | 9/1998 | Yamagishi et al. |
| 6,057,659 | A | 5/2000 | Akiyama et al. |
| 6,628,793 | B1 | 9/2003 | Porzilli et al. |
| 6,751,330 | B2 | 6/2004 | Kowaki et al. |
| 6,968,067 | B2 | 11/2005 | Lopez |
| 7,441,630 | B1 | 10/2008 | Herrington et al. |
| 2005/0058314 | A1 | 3/2005 | Lee et al. |
| 2005/0063559 | A1 | 3/2005 | Lee et al. |

FIG. 10
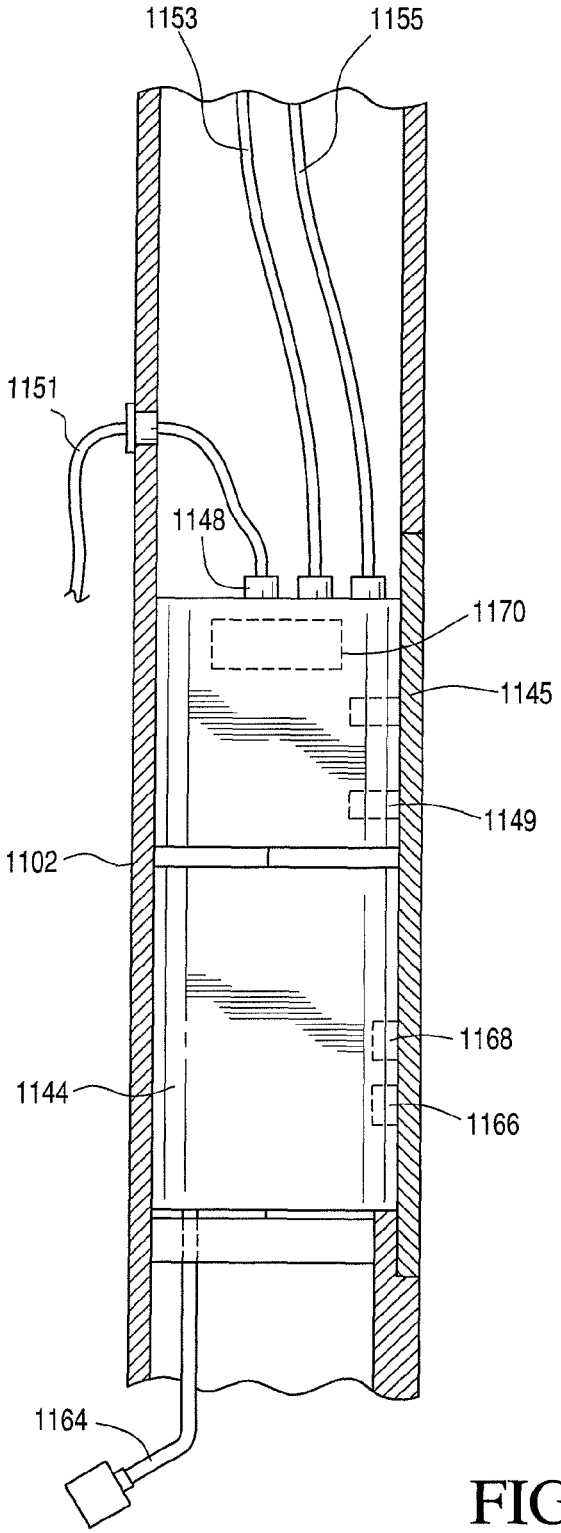
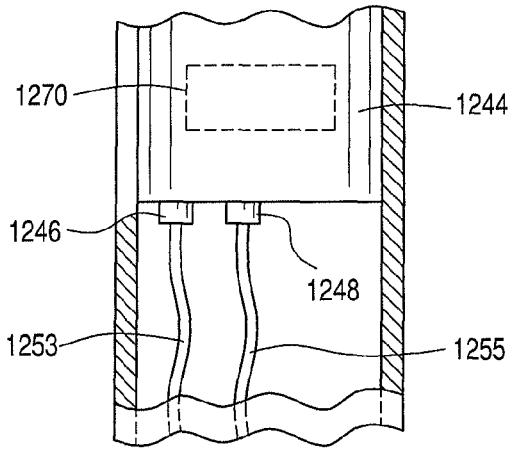
FIG. 11
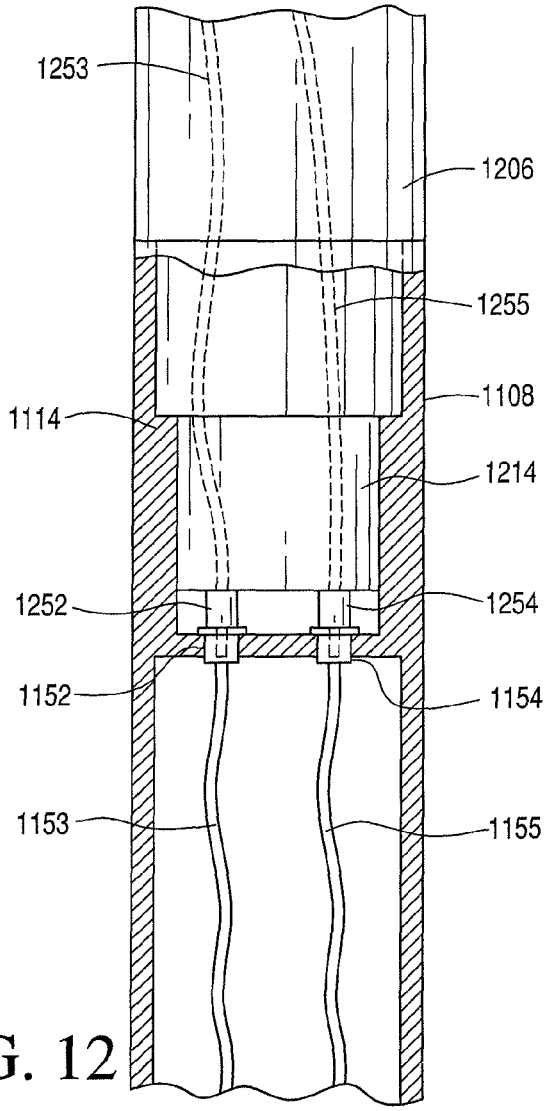
FIG. 12

MODULAR SPEAKER SYSTEM

CROSS REFERENCE TO RELATED APPLICATION

This application is a continuation-in-part of U.S. patent application Ser. No. 12/109,822, filed Apr. 25, 2008 now U.S. Pat. No. 8,165,333, entitled, "MODULAR SPEAKER SYSTEM", which claims the benefit of U.S. Provisional Application Ser. No. 60/907,968, entitled "MODULAR SPEAKER SYSTEM", filed Apr. 25, 2007.

BACKGROUND OF THE INVENTION

1. Field of the Invention

The invention relates to a speaker system. More particularly, the invention relates to a modular speaker system allowing usage at various locations and in various configurations.

2. Description of the Related Art

Musicians are well-acquainted with the cartage of their equipment to and from various venues. In addition to bringing their instruments, musicians often require amplifiers, speakers, woofers, and other components necessary for playing their music before a live audience. This is a difficult, but necessary, aspect of playing live music, or presenting live theatrical performances.

However, each venue presents unique challenges for sound reinforcement, for example, sound production at concerts in various venue sizes, and musicians must often adapt to their environments by utilizing different combinations of equipment to accommodate the wide variety of potential stage setups, hall, theater or auditorium sizes and, perhaps most difficult of all, the outdoor performance setting. This adds another layer to the difficulty of playing live music at different locations and simultaneously striving to maintain excellent sound quality in widely variant acoustic environments.

A need, therefore, exists for a sound reinforcement system which facilitates quick selection and optimization of the components for any given venue, while simultaneously minimizing the size and weight of the equipment which must be transported to and from the various locations. The present invention provides such a speaker system.

SUMMARY OF THE INVENTION

It is, therefore, an object of the present invention to provide a modular speaker system. The system includes a base assembly having a longitudinally extending, central support member. The central support member includes a first end and a second end. A first base driver is secured to the base assembly and a base assembly amplifier is mounted within the central support member and connected to the first base driver. An auxiliary speaker assembly includes a longitudinally extending, auxiliary support member having a first end and a second end, the first end being shaped and dimensioned for selective engagement with the second end of the central support member. A first driver is secured to the auxiliary speaker assembly and an amplifier mounted within the auxiliary support member and the amplifier is connected to the first driver. The first driver is secured to the auxiliary speaker assembly via a first coupling arm extending between the auxiliary support member and the first driver.

It is also an object of the present invention to provide a modular speaker system wherein the first end of the central support member is provided with a planar support member shaped and dimensioned to sit upon a support surface in a manner supporting the base assembly in a stable manner when used in conjunction with a support leg.

It is another object of the present invention to provide a modular speaker system wherein the second end of the central support member includes a coupling member shaped and dimensioned to selectively receive and support the auxiliary speaker assembly.

It is a further object of the present invention to provide a modular speaker system including a second base driver secured to the base assembly.

It is also an object of the present invention to provide a modular speaker system wherein the first base driver includes a base shaped and dimensioned to sit upon a support surface in a stable manner.

It is another object of the present invention to provide a modular speaker system wherein the first base driver is secured to the base assembly via a first coupling arm extending between the central support member and the first base driver.

It is a further object of the present invention to provide a modular speaker system wherein the amplifier includes a source connection and a power connection, the source connection and power connection being linked to an external connection point for connection to a remote source and a remote power source.

It is also an object of the present invention to provide a modular speaker system wherein the first end of the auxiliary support member includes a coupling member shaped and dimensioned for selective engagement with a coupling member at the second end of the central support member.

It is another object of the present invention to provide a modular speaker system including a second driver secured to the auxiliary speaker assembly.

It is a further object of the present invention to provide a modular speaker system wherein the auxiliary amplifier includes a source connection and a power connection, the source connection and power connection being linked to an external connection point for connection to a remote source and a remote power source.

It is also an object of the present invention to provide a modular speaker system including a second auxiliary speaker assembly secured to the auxiliary speaker assembly.

It is another object of the present invention to provide a modular speaker system wherein the base member amplifier is mounted within the central support member and is covered by a plate for ready access by a user of the present speaker assembly.

It is a further object of the present invention to provide a modular speaker system including a light source synchronizable with a music source.

It is also an object of the present invention to provide a modular speaker system including a digital signal processor connected to the base amplifier.

It is another object of the present invention to provide a modular speaker system including a wireless transceiver connected to the digital signal processor and the base amplifier.

It is another object of the present invention to provide a modular speaker system including a wireless transceiver connected to the base amplifier.

It is a further object of the present invention to provide a sound assembly including a first modular speaker system and a second modular speaker system. The first modular speaker system includes a base assembly, a first base driver secured to the base assembly, a base assembly amplifier, a digital signal processor and a wireless transceiver mounted within the base assembly and connected to the first base driver, an auxiliary speaker assembly shaped and dimensioned for selective engagement with the base assembly, a first driver secured to the auxiliary speaker assembly; and an amplifier mounted within the auxiliary support member and the amplifier is connected to the first driver. The second modular speaker system includes a base assembly, a first base driver secured to the base assembly, a base assembly amplifier, a digital signal processor and a wireless transceiver mounted within the base assembly and connected to the first base driver, an auxiliary speaker assembly shaped and dimensioned for selective engagement with the base assembly, a first driver secured to the auxiliary speaker assembly; and an amplifier mounted within the auxiliary support member and the amplifier is connected to the first driver.

It is also an object of the present invention to provide a sound assembly wherein the base assembly of the first modular speaker system includes a longitudinally extending, central support member. The central support member includes a first end a second end, and the base assembly of the second modular speaker system includes a longitudinally extending, central support member, the central support member includes a first end and a second end.

It is another object of the present invention to provide a sound assembly wherein the auxiliary speaker assembly of the first modular speaker system includes a longitudinally extending, auxiliary support member having a first end and a second end, the first end being shaped and dimensioned for selective engagement with the second end of the central support member of the first modular speaker system. The auxiliary speaker assembly of the second modular speaker system includes a longitudinally extending, auxiliary support member having a first end and a second end, the first end being shaped and dimensioned for selective engagement with the second end of the central support member of the second modular speaker system.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 10 is a detailed cross sectional view showing wiring of the first modular speaker in accordance with the embodiment disclosed with reference to FIG. 7.

FIGS. 11 and 12 are cross sectional views showing wiring used in attachment of the base assembly and auxiliary speaker assembly of the first modular speaker in accordance with the embodiment disclosed with reference to FIG. 7.

DESCRIPTION OF THE PREFERRED EMBODIMENTS

Figure 1:
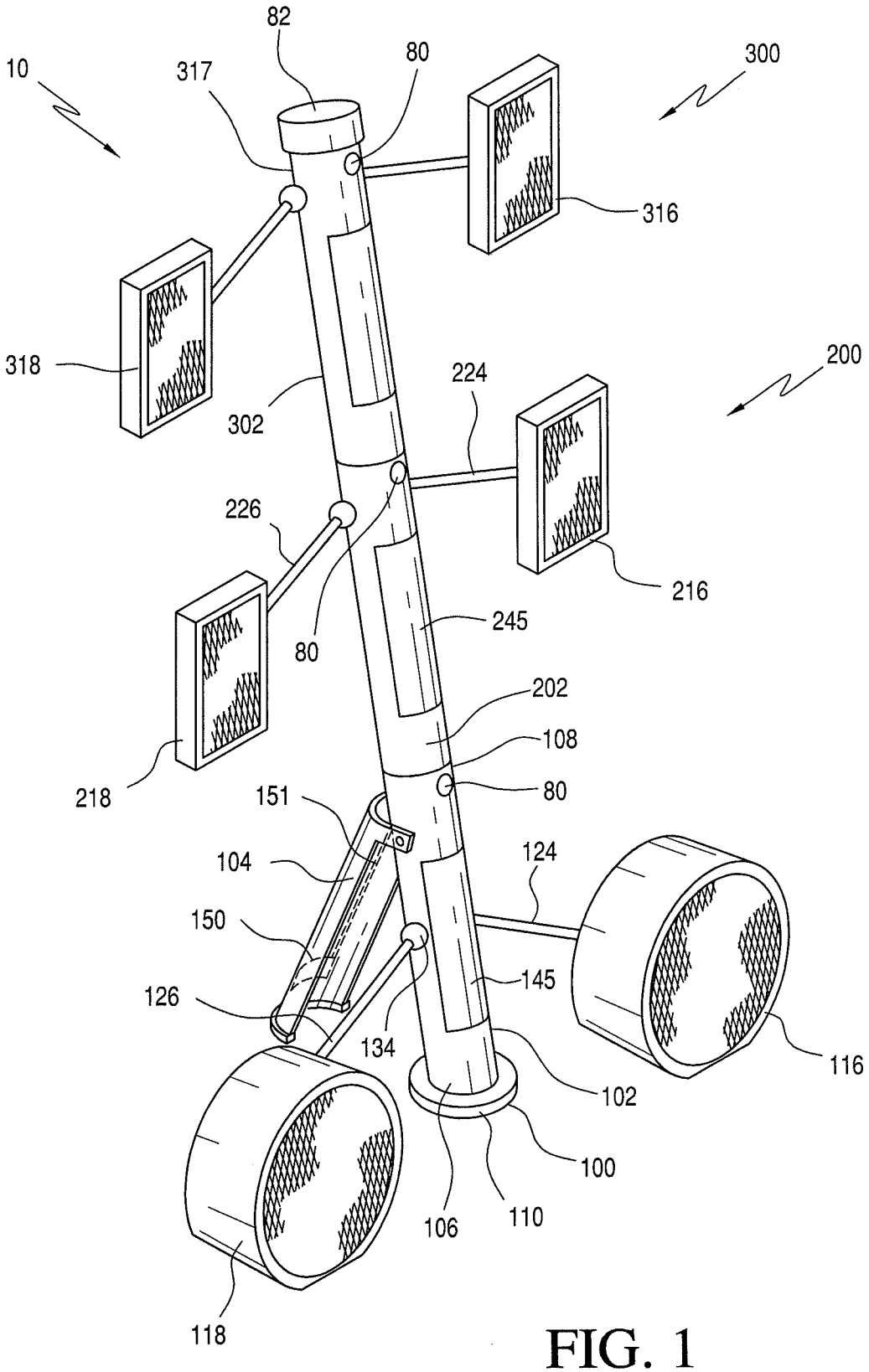
FIG. 1 is a perspective view of the present modular speaker system.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely a basis for teaching one skilled in the art how to make and/or use the invention.

With reference to the various figures, a modular speaker system 10 is disclosed. The speaker system 10 includes a base assembly 100 to which a plurality of auxiliary speaker assemblies 200, 300 may be secured in a manner creating a customized, modular speaker system 10 adapted for creating a customized modular sound reinforcement system, optimized for the power requirements and acoustic criteria of each specific performing (performance) environment. As will be explained in the following disclosure, the present speaker system 10 is adapted for a variety of uses through its modular nature, as well as its ability to permit ready assembly and disassembly.

The base assembly 100 includes a longitudinally extending, cylindrical, central support member 102 and a support leg 104 extending therefrom in a manner supporting the central support member 102 in a generally upright configuration. As will be discussed below in greater detail, the support leg 104 is cylindrical and provides a passageway for coupling the various drivers used in accordance with the present invention with a power source. The support leg 104 is pivotally secured to the central support member 102 allowing the support leg 104 to collapse onto the central support member 102 for compact storage when the present speaker assembly 10 is disassembled.

The central support member 102 includes a first end 106 and a second end 108. The first end 106 is provided with a planar support plate 110 shaped and dimensioned to sit upon a support surface 112 supporting the base assembly 100 in a stable manner when used in conjunction with the support leg 104. The second end 108 of the central support member 102 includes a coupling member 114 shaped and dimensioned to selectively receive and support an auxiliary speaker assembly 200. In accordance with a preferred embodiment, the coupling member 114 is a female coupling member shaped and dimensioned to receive a similarly shaped male coupling member 214 extending from the auxiliary speaker assembly 200 in a manner discussed below in greater detail. The female and male coupling members 114, 214 may further be provided with selective locking structures for adding to the stability of the connection between the central support member 102 and the auxiliary speaker assembly 200. In accordance with a preferred embodiment of the present invention, the female and male coupling members 114, 214 are provided with bayonet type locking structures, although those skilled in the art will appreciate other coupling mechanisms may be employed without departing from the spirit of the present invention.

A first woofer 116 and a second woofer 118 are secured to the base assembly 100. Each of the first and second woofers 116, 118 includes a base 120, 122 shaped and dimensioned to sit upon a support surface 112 in a stable manner taking advantage of the mass of the woofers 116, 118 to significantly lower the whole assembly's center of gravity. As such, the first and second woofers 116, 118 support themselves upon the support surface 112 while also adding to the stability of the base assembly 100 by functioning as additional legs extending from the central support member 102. This adds stability to the entire speaker assembly 10 and allows for the attachment of additional auxiliary speaker assemblies in the manner discussed below.

Figure 3:
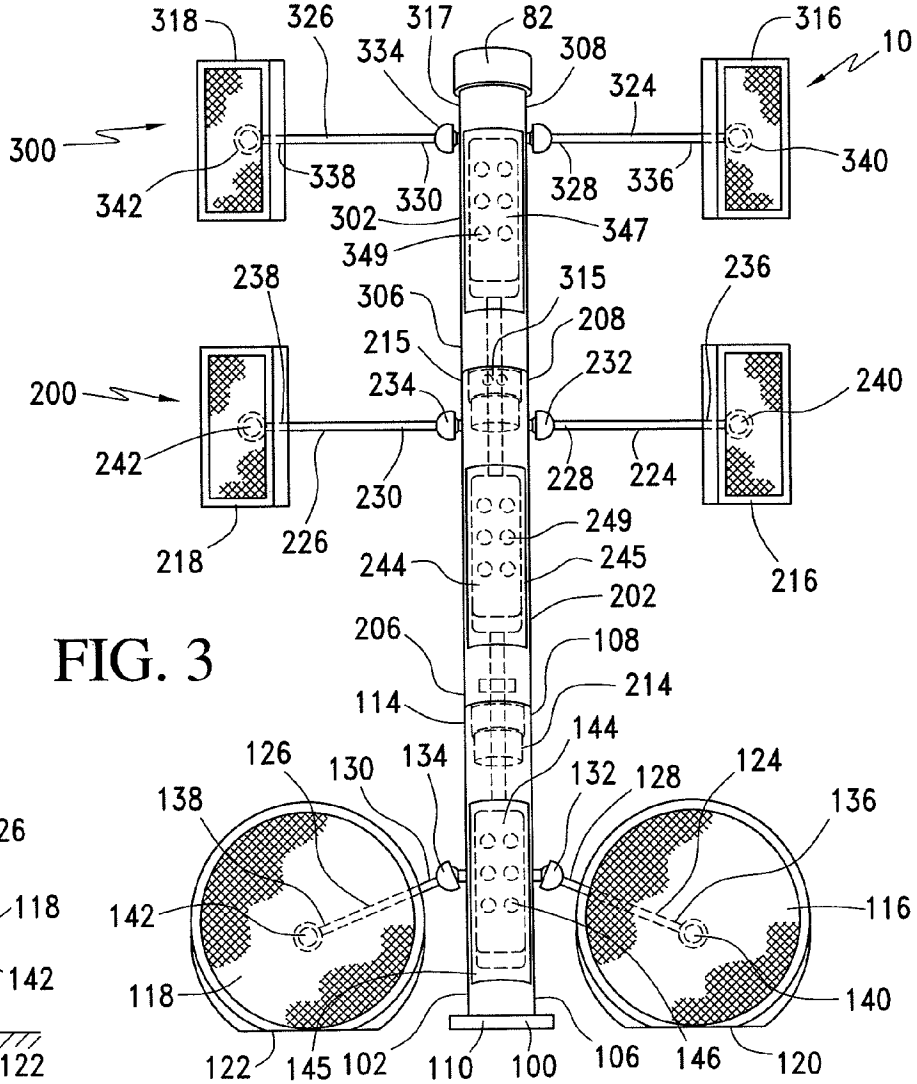
FIGS. 2 and 3 are respectively a side view and a front plan view of the system.
Figure 2:
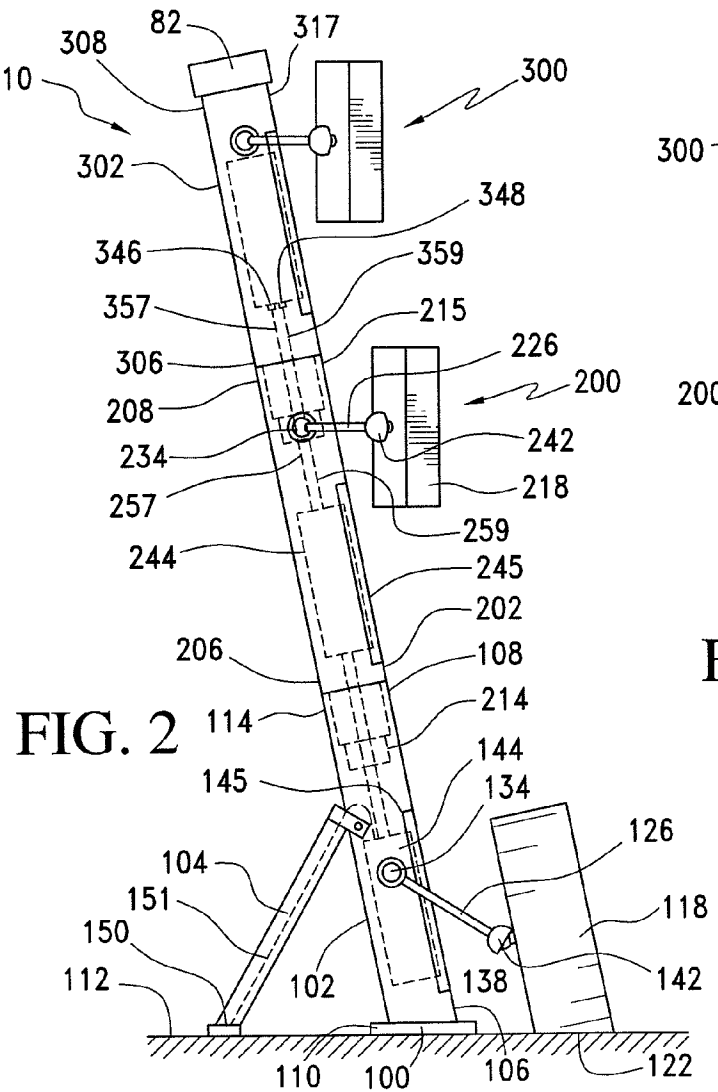
Figure 4:
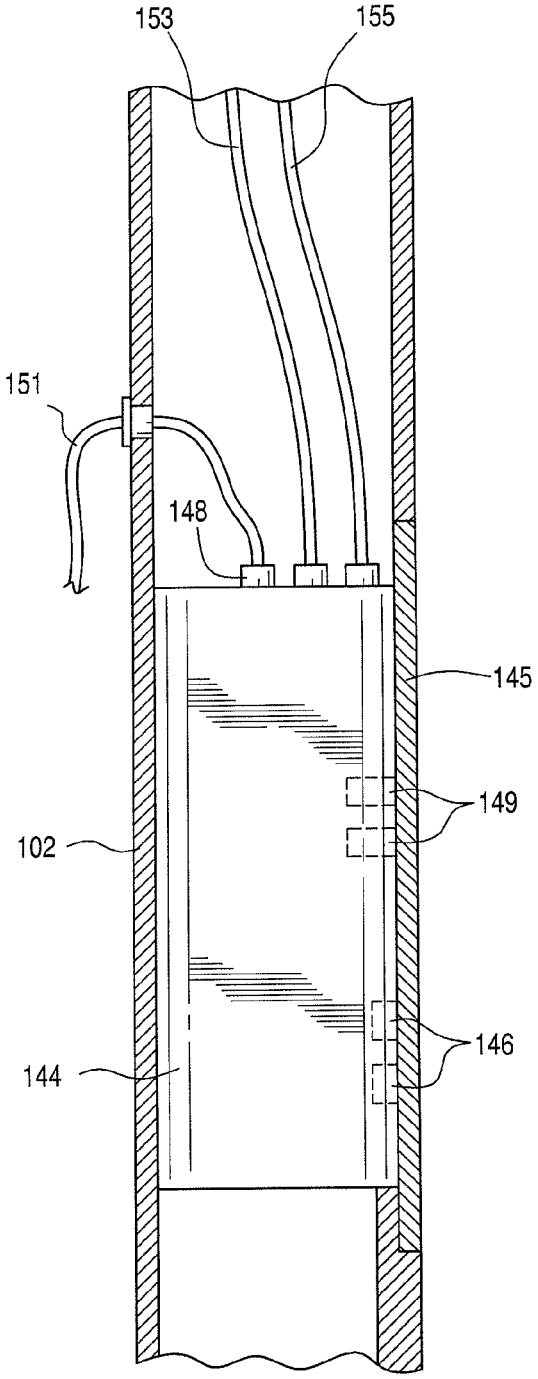
FIG. 4 is a detailed cross sectional view showing wiring in accordance with the present invention.
Figure 5:
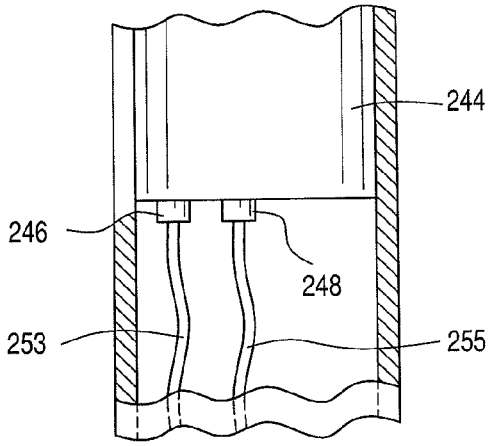
FIGS. 5 and 6 are cross sectional views showing wiring used in attachment of the base assembly and auxiliary speaker assembly.
Figure 6:
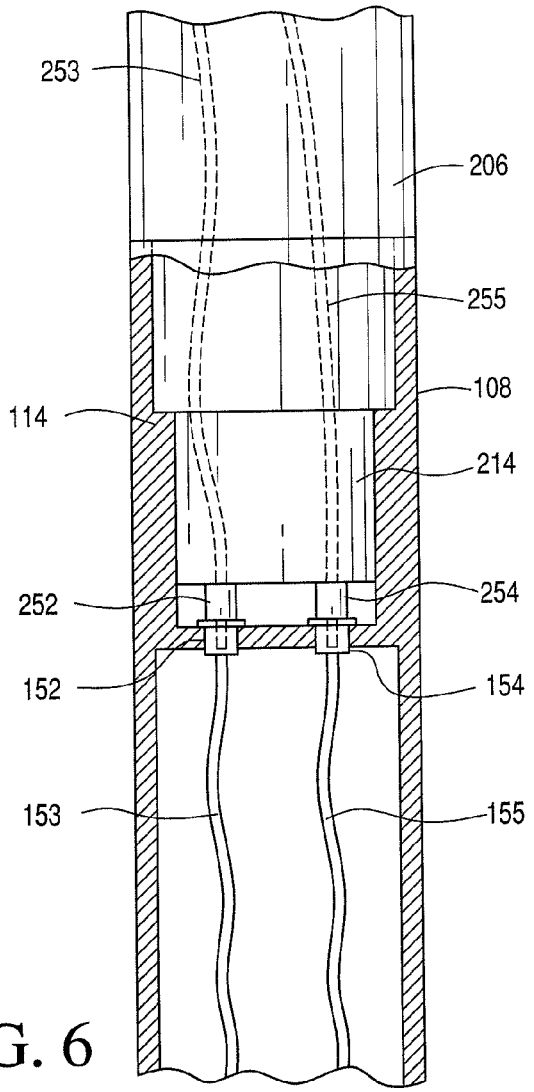

First and second coupling arms 124, 126 extend between the central support member 102 and the respective first and second woofers 116, 118. Each of the first and second coupling arms 124, 126 includes a first and a second end. The first ends 128, 130 of the first and second coupling arms 124, 126 are coupled to the central support member 102 via a swivel joint 132, 134 allowing free movement therebetween and the second ends 136, 138 of the first and second coupling arms 124, 126 are similarly coupled to the respective first and second woofers 116, 118 via a swivel joint 140, 142 allowing free movement therebetween. The use of swivel joints 132, 134 in connecting the first and second coupling arms 124, 126 to the central support member allows the woofers 116, 118 to be folded close to the central support member 102 during storage and moved outwardly as shown in FIGS. 1, 2 and 3 when the speaker assembly 10 is placed into use. It is contemplated in accordance with a preferred embodiment of the present invention the swivel joints are of a ball and socket type construction and are maintained in desired orientations through the implementation of various locking structures (not shown) known to those skilled in the art. For example, the locking structure may take the form of locking pins, compression members, frictional resistance members, etc.

A base member amplifier 144 is mounted within the central support member 102 and drives the first and second woofers 116, 118. Those skilled in the art will appreciate the base member amplifier may also be provided with various signal processing components known to those skilled in the art. The base member amplifier 144 is mounted within the central support member 102 and is covered by a removable plate 145 for ready access by a user of the present speaker assembly 10. It is appreciated the plate may be slidingly or pivotally secured to the central support member to allow access to the base member amplifier, while not requiring that the plate be fully removed from the central support member thus preventing the possibility that the plate might be misplaced after being removed from the central support member.

The base member amplifier 144 is electrically coupled to the respective first and second woofers 116, 118 via wires (not shown) extending from the base member amplifier 144, through the central support member 102, through the respective first and second coupling arms 124, 126 and into the connections of the first woofer 116 and the second woofer 118.

The base member amplifier 144 further includes source connections 146, a power connection 148 and various control members 149. The source connections 146 allow for one to attach various sound sources directly to the base member amplifier 144. The source signals are then processed by the base member amplifier 144 using conventional sound processing techniques and distributed to the various drivers making up the present speaker assembly 10. The power connection 148 of the base member amplifier is linked to an external connection point 150 within the support leg 104 via a wire 151 for connection to a remote power source.

As discussed above, the base assembly 100 is shaped and dimensioned for supporting one or more auxiliary speaker assemblies 200, 300. The first auxiliary speaker assembly 200 includes a longitudinally extending, auxiliary support member 202 having a first end 206 and a second end 208. The first end 206 includes a coupling member 214 shaped and dimensioned for selective engagement with the coupling member 114 at the second end 108 of the central support member 102. More particularly, and as discussed above in accordance with a preferred embodiment of the present invention, the coupling member 214 at the first end 206 of the auxiliary support member 202 is a male coupling member shaped and dimensioned for receipt within the female coupling member 114 at the second end 108 of the central support member 102 of the base assembly 100.

The second end 208 of the auxiliary support member 202 includes a coupling member 215 shaped and dimensioned to selectively receive and support an additional auxiliary speaker assembly 300. As with the respective male and female coupling members 214, 114 of the auxiliary support member 202 and the central support member 102, and in accordance with a preferred embodiment of the present invention, the coupling member 215 at the second end 208 of the auxiliary support member 202 is a female coupling member shaped and dimensioned to receive a similarly shaped male member 315 extending from another auxiliary speaker assembly 300. As with the connection of the base assembly and the auxiliary speaker assembly, the male and female coupling members 315, 215 may further be provided with selective locking structures for adding to the stability of the connection between the auxiliary support member 202 and the auxiliary speaker assembly 300.

The auxiliary speaker assembly 200 includes a first support arm 224 connecting a first driver 216 to the auxiliary support member 202 and a second support arm 226 connecting a second driver 218 to the auxiliary support member 202. Each of the first and second support arms 224, 226 includes a first and a second end. The first ends 228, 230 of the first and second support arms 224, 226 are coupled to the auxiliary support member 202 via a swivel joint 232, 234 allowing free movement therebetween and the second ends 236, 238 of the first and second support arms 224, 226 are similarly coupled to the respectively first and second driver assemblies (for example, and in accordance with a preferred embodiment, which is composed of a midrange driver and tweeter, or high frequency driver (not shown)) 216, 218 via a swivel joint 240, 242 allowing free movement therebetween. The use of swivel joints 232, 234 in connecting the first and second coupling arms 224, 226 to the auxiliary support member 202 allows the first and second driver assemblies 216, 218 to be folded close to the auxiliary support member 202 during storage and moved outwardly as shown in FIG. 1 when the speaker assembly 10 is placed into use. As discussed above with regard to the base assembly, the swivel joints are maintained in desired orientations through the implementation of various locking structures (not shown) known to those skilled in the art. For example, the locking structure may take the form of locking pins, compression members, frictional resistance members, etc.

An auxiliary member amplifier 244 drives the first and second drivers 216, 218. The auxiliary member amplifier 244 is mounted within the auxiliary support member 202 and is covered by a removable plate 247 for ready access to various control members/source inputs 249 along the auxiliary member amplifier 244 by a user of the present speaker assembly 10. The auxiliary member amplifier 244 is electrically coupled to the respective first and second driver assemblies 216, 218 via wires (not shown) extending from the auxiliary member amplifier 244, through the auxiliary support member 202, through the respective first and second support arms 224, 226 and into the connections of the first driver 216 and the second driver 218.

The auxiliary member amplifier 244 further includes a source connection 246 and a power connection 248. The source connection 246 and power connection 248 are linked to the base member amplifier 144 via output wires 153, 155 providing a power and source output from the base member amplifier 144. This is achieved by extending input wires 253, 255 from the source connection 246 and the power connection 248 of the auxiliary member amplifier 244 to the first end 206 of the auxiliary support member 202. The input wires 253, 255 are provided with terminal connections 252, 254 shaped and dimensioned for selective coupling with the output wires 153, 155 extending from the base member amplifier 144 to the second end 108 of the central support member 102. As with the input wires 253, 255 of the auxiliary member amplifier 244, the output wires 153, 155 of the base member amplifier 144 are provided with mating terminal connections 152, 154 shaped and dimensioned for selective coupling with the terminal connections 252, 254 of the input wires 253, 255 of the auxiliary member amplifier 244. As those skilled in the art will appreciate, the wires and connections employed in linking the base member amplifier to the auxiliary member amplifier may take various forms, including but not limited to RCA connections, XLR (extra long run) balanced line connections (typically 600 Ohm impedance and are used for microphones, etc. in TV, sound reinforcement and recording studios), optical connections, USB connections, Firewire connections, Ethernet connections, as well as integrally formed pin connection structures commonly used in the electronics industry.

As shown in accordance with the embodiment disclosed with reference to FIG. 3, the speaker assembly 10 is provided with a second auxiliary speaker assembly 300. As with the other auxiliary speaker assembly discussed above, this auxiliary speaker assembly includes a longitudinally extending, auxiliary support member 302 having a first end 306 a second end 308. The first end 306 includes a male coupling member 315 shaped and dimensioned for selective engagement with the female coupling member 215 at the second end 208 of the auxiliary support member 202. The male coupling member 315 at the first end 306 of the auxiliary support member 302 is a male coupling member shaped and dimensioned for receipt within the female coupling member 215 at the second end 208 of the auxiliary support member 202 of the auxiliary speaker assembly 200. The second end 308 of the auxiliary support member 302 includes a coupling member 317 shaped and dimensioned to selectively receive and support an additional auxiliary speaker assembly.

The auxiliary speaker assembly 300 includes a first support arm 324 connecting a first driver 316 to the auxiliary support member 202 and a second support arm 326 connecting a second driver 318 to the auxiliary support member 202. Each of the first and second support arms 324, 326 includes a first and a second end. The first ends 328, 330 of the first and second support arms 324, 326 are coupled to the auxiliary support member 202 via a swivel joint 332, 334 allowing free movement therebetween and the second ends 336, 338 of the first and second support arms 324, 326 are similarly coupled to the respective first and second driver assemblies (for example, and in accordance with a preferred embodiment, which is composed of a midrange driver and tweeter, or high frequency driver (not shown)) 316, 318 via a swivel joint 340, 342 allowing free movement therebetween. As discussed above with regard to the base assembly, the swivel joints are maintained in desired orientations through the implementation of various locking structures (not shown) known to those skilled in the art. For example, the locking structure may take the form of locking pins, compression members, frictional resistance members, etc. As with the auxiliary speaker assembly discussed above, the use of swivel joints in connecting the first and second coupling arms to the auxiliary support member allows the first and second drivers to be folded close to the auxiliary support member during storage and moved outwardly as shown in FIG. 1 when the speaker assembly 10 is placed into use.

An auxiliary member amplifier 344 drives the first and second driver assemblies 316, 318. This auxiliary member amplifier 344 is substantially similar to the one discussed above. As such, the auxiliary member amplifier 344 is mounted within the auxiliary support member 302 and is covered by a removable plate 347 for ready access to various control members/source inputs 349 along the auxiliary member amplifier 344 by a user of the present speaker assembly 10. The auxiliary member amplifier 344 includes a source connection 346 and a power connection 248. The source connection 246 and power connection 248 are linked to the auxiliary member amplifier 244 via output wires 257, 259 of the auxiliary member amplifier 244 providing a power and source output from the auxiliary member amplifier 244. This is achieved by extending input wires 357, 359 from the source connection 346 and the power connection 348 of the auxiliary member amplifier 344 to the first end 306 of the auxiliary support member 302. The input wires are provided with terminal connections (not shown) shaped and dimensioned for selective coupling with the output wires 257, 259 extending from the auxiliary member amplifier 244 to the second end 208 of the central support member 202. As with the input wires 357, 359 of the auxiliary member amplifier 244, the output wires of the auxiliary member amplifier 244 are provided with mating terminal connections (not shown) shaped and dimensioned for selective coupling with the terminal connections 352, 354 of the input wires of the auxiliary member amplifier 344. As those skilled in the art will appreciate, the wires and connections employed in linking the base member amplifier to the auxiliary member amplifier may take various forms, including but not limited to RCA connections, XLR (extra long run) connections, optical connections, USB connections, Firewire connections, Ethernet connections, as well as integrally formed pin connection structures commonly used in the electronics industry. Those skilled in the art will appreciate, that because multiple auxiliary speaker assemblies may be used, auxiliary speaker assembly 300 (as well as any other auxiliary speaker assemblies) discussed herein would also include output wires as disclosed with reference to auxiliary speaker assembly 200.

Although first and second auxiliary speaker assemblies are disclosed in accordance with a preferred embodiment, those skilled in the art will appreciate, that a single auxiliary speaker assembly or more than two auxiliary speaker assemblies may be employed without departing from the spirit of the present invention. In addition, although driver assemblies composed of a midrange and tweeter are disclosed in accordance with a preferred embodiment, those skilled the art will appreciate the specifics drivers employed in the implementation of the present invention may be varied without departing from the spirit of the present invention.

Functionality of the present modular speaker assembly may further be enhanced by the inclusion of a synchronizable light source or sources 80, for example utilizing light-emitting diodes, organic light-emitting diodes, electro-luminescent films, etc., such that the amplitude, frequency and harmonic composition of the music being reproduced is displayed on the surface of the modular speaker system and varies from dim to intense for amplitude, deep red for the lowest bass frequencies up through to blue for the highest treble frequencies. The displays may be concentrically or coaxially, that is longitudinally, oriented. The light source/sources may be recessed into a channel or series of channels for protection during transport, setup and breakdown of the sound reinforcement assembly.

In addition, cooling of the present speaker assembly 10 is enhanced by the inclusion of fan 82 integrated into a removable cap for placement upon the top auxiliary speaker assembly (in accordance with the disclosed embodiment, auxiliary speaker assembly 300). The fan 82 is oriented to draw air from the internal cavity defined by the base assembly and the auxiliary speaker assembly(ies), creating a constant, cooling airflow within the present speaker assembly 10. In accordance with a preferred embodiment of the present invention, power for the fan may be provided by either connecting the fan to the power source passing through the speaker assembly or via battery power. In addition, it is contemplated many of the components of the speaker assembly will be manufactured from aluminum which functions as a natural heat sink.

Ease of construction and assembly is achieved by making the base support member 102 and the auxiliary support members 202, 302 with the same diameter. This will allow for the use of similar materials during construction, and permit versatility in the order in which various auxiliary speaker assemblies are coupled together.

In accordance with an alternate embodiment, and with reference to FIGS. 7 to 12, the system is provided as a sound assembly 1000 composed of first and second modular speaker systems 1010, 2010, with digital signal processing and wireless connectivity as will be described below in greater detail. The provision of first and second modular speaker systems 1010, 2010 allows a musician to set up and project sound using left and right (or more) channels for the enjoyment of his or her music.

The first modular speaker system 1010 and the second modular speaker system 2010 are substantially the same and each includes features of the embodiment disclosed with reference to FIGS. 1 to 6. In contrast, however, with the embodiment disclosed with reference to FIGS. 1 to 6, each of the first and second modular speaker systems 1010, 2010 is provided with a wireless transceiver 1160, 2160 and an associated digital signal processor 1162, 2162 such that the first and second modular speaker systems 1010, 2010 may communicate for the transfer of information in the processing of signals for the projection of sound.

The first and second modular speaker systems 1010, 2010 are identical and, therefore, only the first modular speaker system 1010 is described herein. The first modular speaker system 1010 includes a base assembly 1100 to which a plurality of auxiliary speaker assemblies 1200, 1300 may be secured. The base assembly 1100 includes a longitudinally extending, cylindrical, central support member 1102 and a support leg 1104 extending therefrom in a manner supporting the central support member 1102 in a generally upright configuration. The support leg 1104 is cylindrical and provides a passageway for coupling the various drivers used in accordance with the present invention with a power source. The support leg 1104 is pivotally secured to the central support member 1102 allowing the support leg 1104 to collapse onto the central support member 1102 for compact storage when the present speaker assembly 1010 is disassembled.

The central support member 1102 includes a first end 1106 and a second end 1108. The first end 1106 is provided with a planar support plate 1110 shaped and dimensioned to sit upon a support surface 1112 supporting the base assembly 1100 in a stable manner when used in conjunction with the support leg 1104. The second end 1108 of the central support member 1102 includes a coupling member 1114 shaped and dimensioned to selectively receive and support an auxiliary speaker assembly 1200. In accordance with a preferred embodiment, the coupling member 1114 is a female coupling member shaped and dimensioned to receive a similarly shaped male coupling member 1214 extending from the auxiliary speaker assembly 1200.

A first woofer 1116 and a second woofer 1118 are secured to the base assembly 1100. Each of the first and second woofers 1116, 1118 includes a base 1120, 1122 shaped and dimensioned to sit upon a support surface 1112 in a stable manner taking advantage of the mass of the woofers 1116, 1118 to significantly lower the whole assembly's center of gravity. As such, the first and second woofers 1116, 1118 support themselves upon the support surface 1112 while also adding to the stability of the base assembly 1100 by functioning as additional legs extending from the central support member 1102. This adds stability to the entire speaker assembly 1010 and allows for the attachment of additional auxiliary speaker assemblies in the manner discussed below.

First and second coupling arms 1124, 1126 extend between the central support member 1102 and the respective first and second woofers 1116, 1118. Each of the first and second coupling arms 1124, 1126 includes a first and a second end. The first ends 1128, 1130 of the first and second coupling arms 1124, 1126 are coupled to the central support member 1102 via a swivel joint 1132, 1134 allowing free movement therebetween and the second ends 1136, 1138 of the first and second coupling arms 1124, 1126 are similarly coupled to the respectively first and second woofers 1116, 1118 via a swivel joint 1140, 1142 allowing free movement therebetween.

Signal transmission and sound reproduction are controlled and facilitated by the provision of a wireless transceiver 1160, a digital signal processor 1162 and a base member amplifier 1144. As is appreciated, the digital signal processor 1162 allows for "mixing of sound" where the "panning" of the various sources and "channel assignments" is achieved. In accordance with a preferred embodiment the wireless transceiver 1160, the digital signal processor 1162 and a base member amplifier 1144 are mounted within the central support member 1102. The wireless transceiver 1160, the digital signal processor 1162 and the base member amplifier 1144 are covered by a cover plate 1145 for ready access by a user of the present speaker assembly 1010. In accordance with a preferred embodiment, the cover plate 1145 is slidingly or pivotally secured to the central support member 1102 to allow access to the base member amplifier 1144, digital signal processor 1162 and the wireless transceiver 1160. The sliding or pivotal mounting of the cover plate 1145 allows for access while not requiring that the cover plate 1145 be fully removed from the central support member 1102 thus preventing the possibility that the plate might be misplaced after being removed from the central support member.

Although the wireless transceiver, digital signal processor and base member amplifier are disclosed as separate elements, it is appreciated that the signal processing circuitry of the digital signal processor, the wireless transceiver and the base assembly amplifier may be integrated within a unitary housing.

The wireless transceiver 1160 facilitates the wireless transmission of audio signals between the first and second modular speaker systems 1010, 2010, as well as between the first and second modular speaker systems 1010, 2010 and an audio signal source, for example, musical instrument, microphone, etc.

The source signals received by the wireless transceiver 1160 are transmitted to the digital signal processor 1162 where they are processed in accordance with predetermined protocols. As will be appreciated based upon the following disclosure, the source signals are processed by the digital signal processor 1162 using sound and data processing techniques and distributed to the various drivers making up the present speaker assembly 1010. The digital signal processor 1162 includes wired source connections 1164 (discussed below in greater detail), a power connection 1166 and various control members 1168. Power for the wireless transceiver 1160 (as well as the base member amplifier 1144) is provided via the respective connections between the digital signal processor 1162, the wireless transceiver 1160 and the base member amplifier 1144. The power connection 1166 of the digital signal processor 1162 is linked to an external connection point 1150 within the support leg 1104 via a wire 1151 for connection to a remote power source.

The wireless transceiver 1160, digital signal processor 1162 and base member amplifier 1144 are covered by the cover plate 1145 and therefore may be readily accessed by users. As such, the signal processing protocols of the digital signal processor 1162 may be readily controlled by the user. It is further appreciated wireless control techniques may be implemented using the wireless transceiver 1160 as the bridge for transmitting control signals to the digital signal processor 1162.

In addition to input from the wireless transceiver 1160, the digital signal processor 1162 is provided with a wired source connection 1164 with the ability to receive audio and data source signals via wired transmission from an audio or data signal source. In accordance with a preferred embodiment, and in an effort to simplify set-up of the present first and second modular speaker systems 1010, 2010, the wired audio source need only be connected to digital signal processor 1162, 2162 of either the first or second modular speaker systems 1010, 2010. The appropriate signals will then be wirelessly transmitted to the other modular speaker system via the wireless transceivers 1160, 2160.

Considering the provision of wireless transceivers 1160, 2160 in accordance with the present invention, the source signals may be processed in a variety of manners to achieve the goals of the user. For example, the first and second modular speaker systems 1010, 2010 may be simply provided with traditional left and right stereo signals. More sophisticated scenarios are also possible, where the various drivers of the first and second modular speaker systems 1010, 2010 are driven in accordance with highly specific protocols. In this way, a single modular speaker system (or multiple modular speaker systems) may be utilized for the transmission of multiple channels of sound information.

The processed signals from the digital signal processor 1162, 2162 (that is, for example, voice "mixed" to the center coming equally from both left and right, guitar coming from one side, keyboard sounds from the other or played in a stereo mode) are transmitted to the base member amplifier 1144 which then drives the first and second woofers 1116, 1118. The base member amplifier 1144 is electrically coupled to the respective first and second woofers 1116, 1118 via wires (not shown) extending from the base member amplifier 1144, through the central support member 1102, through the respective first and second coupling arms 1124, 1126 and into the connections of the first woofer 1116 and the second woofer 1118.

The base member amplifier 1144 further includes source connections 1146 and power connection 1148 coupled to the digital signal processor 1162, as well as various control members 1149. The base member amplifier 1144 also provides for adjustment of crossover points for the different drivers used in the manufacture of the modular speaker system. It is also appreciated the various drivers of the modular speaker system could actively or passively set a crossover point when connected to the modular speaker system. This would prevent a driver from being blown out by an incorrect/inappropriate crossover setting.

As discussed above, the base assembly 1100 is shaped and dimensioned for supporting one or more auxiliary speaker assemblies 1200, 1300. The first auxiliary speaker assembly 1200 includes a longitudinally extending, auxiliary support member 1202 having a first end 1206 and a second end 1208. The first end 1206 includes a coupling member 1214 shaped and dimensioned for selective engagement with the coupling member 1114 at the second end 1108 of the central support member 1102. More particularly, the coupling member 1214 at the first end 1206 of the auxiliary support member 1202 is a male coupling member shaped and dimensioned for receipt within the female coupling member 1114 at the second end 1108 of the central support member 1102 of the base assembly 1100.

The second end 1208 of the auxiliary support member 1202 includes a coupling member 1215 shaped and dimensioned to selectively receive and support an additional auxiliary speaker assembly 1300. As with the respective male and female coupling members 1214, 1114 of the auxiliary support member 1202 and the central support member 1102, and in accordance with a preferred embodiment of the present invention, the coupling member 1215 at the second end 1208 of the auxiliary support member 1202 is female coupling member shaped and dimensioned to receive a similarly shaped male member 1315 extending from another auxiliary speaker assembly 1300. As with the connection of the base assembly and the auxiliary speaker assembly, the male and female coupling members 1315, 1215 may further be provided with selective locking structures for adding to the stability of the connection between the auxiliary support member 1202 and the auxiliary speaker assembly 1300.

Figure 7B:
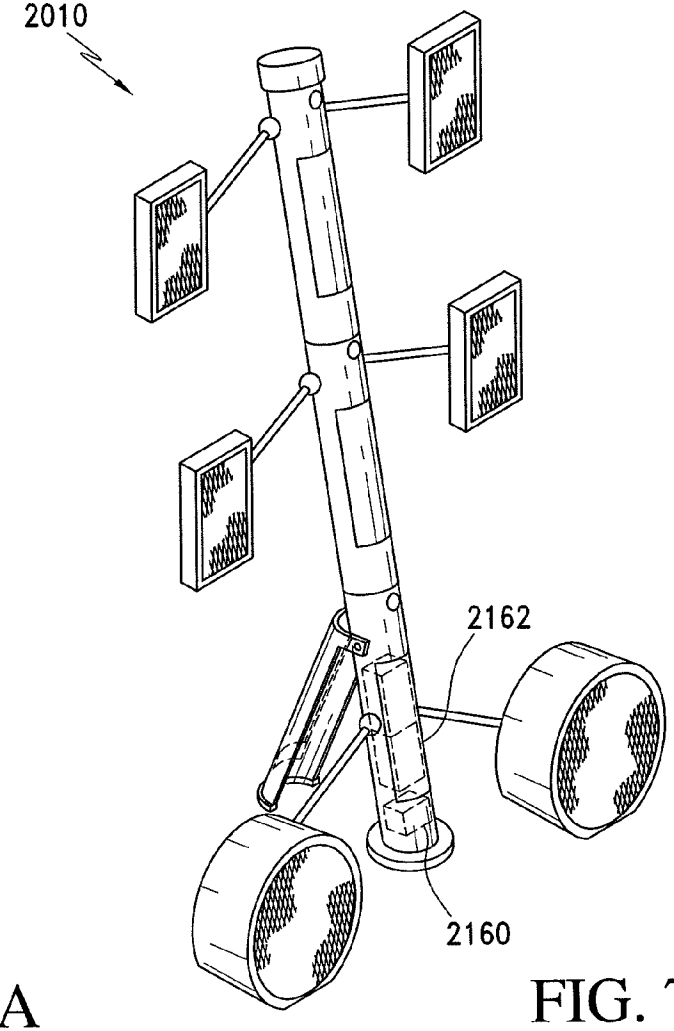
FIG. 7 is a perspective view of an alternate embodiment employing first and second modular speaker systems.
Figure 7A:
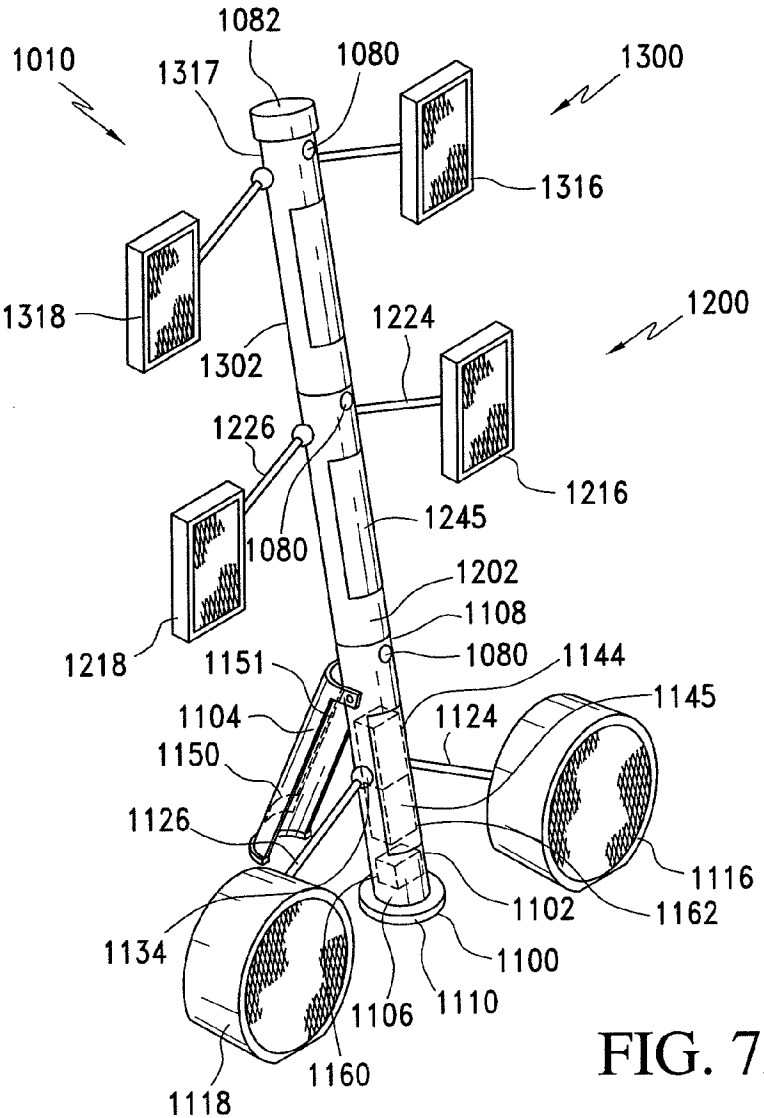

The auxiliary speaker assembly 1200 includes a first support arm 1224 connecting a first driver 1216 to the auxiliary support member 1202 and a second support arm 1226 connecting a second driver 1218 to the auxiliary support member 1202. Each of the first and second support arms 1224, 1226 includes a first and a second end. The first ends 1228, 1230 of the first and second support arms 1224, 1226 are coupled to the auxiliary support member 1202 via a swivel joint 1232, 1234 allowing free movement therebetween and the second ends 1236, 1238 of the first and second support arms 1224, 1226 are similarly coupled to the respective first and second driver assemblies (for example, and in accordance with a preferred embodiment, which is composed of a midrange driver and tweeter, or high frequency driver (not shown)) 1216, 1218 via a swivel joint 1240, 1242 allowing free movement therebetween. The use of swivel joints 1232, 1234 in connecting the first and second coupling arms 1224, 1226 to the auxiliary support member 1202 allows the first and second driver assemblies 1216, 1218 to be folded close to the auxiliary support member 1202 during storage and moved outwardly as shown in FIG. 7 when the present modular speaker system 1010 is placed into use.

An auxiliary member amplifier 1244 drives the first and second drivers 1216, 1218. The auxiliary member amplifier 1244 is mounted within the auxiliary support member 1202 and is covered by a removable plate 1247 for ready access to various control members/source inputs 1249 along the auxiliary member amplifier 1244 by a user of the present modular speaker system 1010. The auxiliary member amplifier 1244 is electrically coupled to the respective first and second driver assemblies 1216, 1218 via wires (not shown) extending from the auxiliary member amplifier 1244, through the auxiliary support member 1202, through the respective first and second support arms 1224, 1226 and into the connections of the first driver 1216 and the second driver 1218.

The auxiliary member amplifier 1244 further includes a source connection 1246 and a power connection 1248. The source connection 1246 and power connection 1248 are linked to the base member amplifier 1144 (and ultimately the digital signal processor 1162) via output wires 1153, 1155 providing a power and source output from the base member amplifier 1144. This is achieved by extending input wires 1253, 1255 from the source connection 1246 and the power connection 1248 of the auxiliary member amplifier 1244 to the first end 1206 of the auxiliary support member 1202. The input wires 1253, 1255 are provided with terminal connections 1252, 1254 shaped and dimensioned for selective coupling with the output wires 1153, 1155 extending from the base member amplifier 1144 to the second end 1108 of the central support member 1102. As with the input wires 1253, 1255 of the auxiliary member amplifier 1244, the output wires 1153, 1155 of the base member amplifier 1144 are provided with mating terminal connections 1152, 1154 shaped and dimensioned for selective coupling with the terminal connections 1252, 1254 of the input wires 1253, 1255 of the auxiliary member amplifier 1244. While the relay of digital signal processor signals and power is contemplated in accordance with a disclosed embodiment, it is appreciated the digital signal processor could be directly wired for connection to the auxiliary member amplifier.

The ability of the base member amplifier 1144 to relay signals and power from the digital signal processor 1162 to the auxiliary member amplifier is achieved by providing the base member amplifier 1144 with a microprocessor 1170 controlling the functioning of the base member amplifier 1144 and allowing it to function as a "smart" amplifier.

Figure 9:
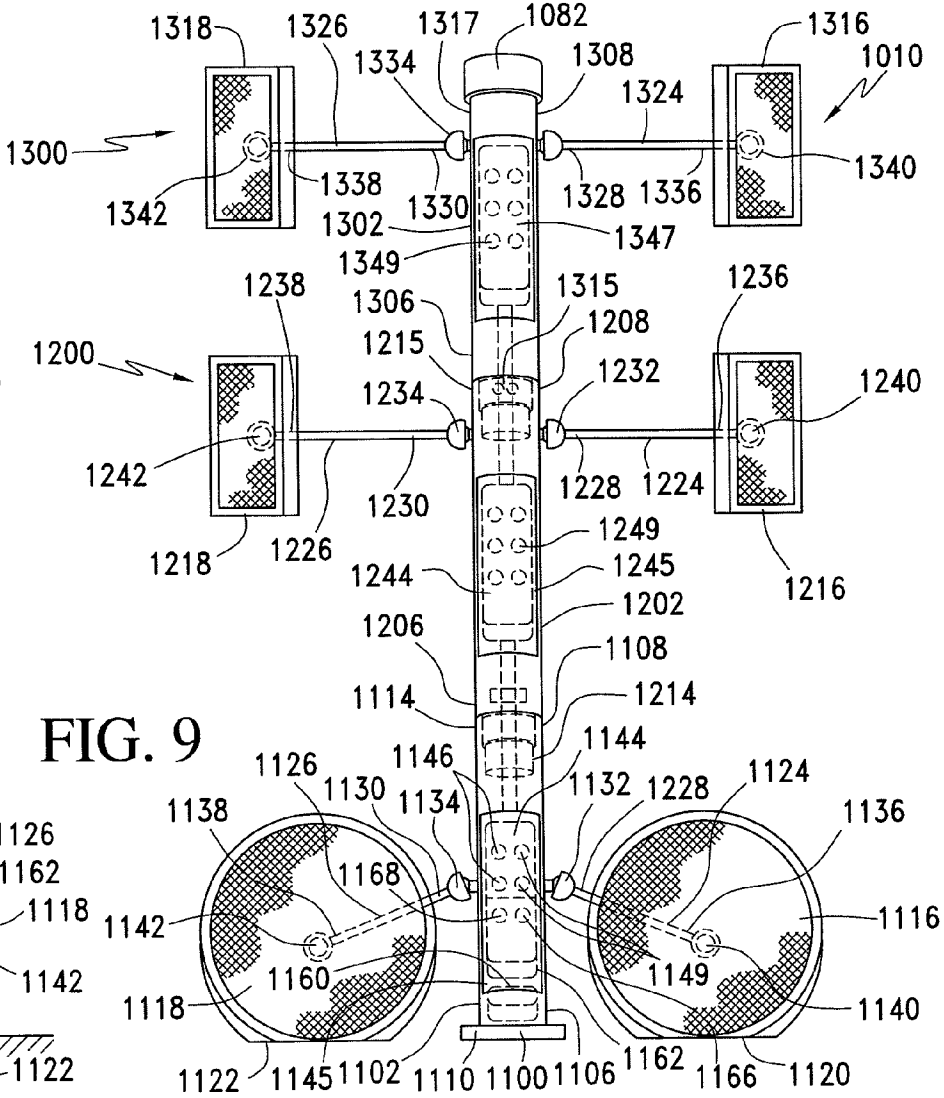
FIGS. 8 and 9 are respectively a side view and a front plan view of the first modular speaker system shown in FIG. 7.
Figure 8:
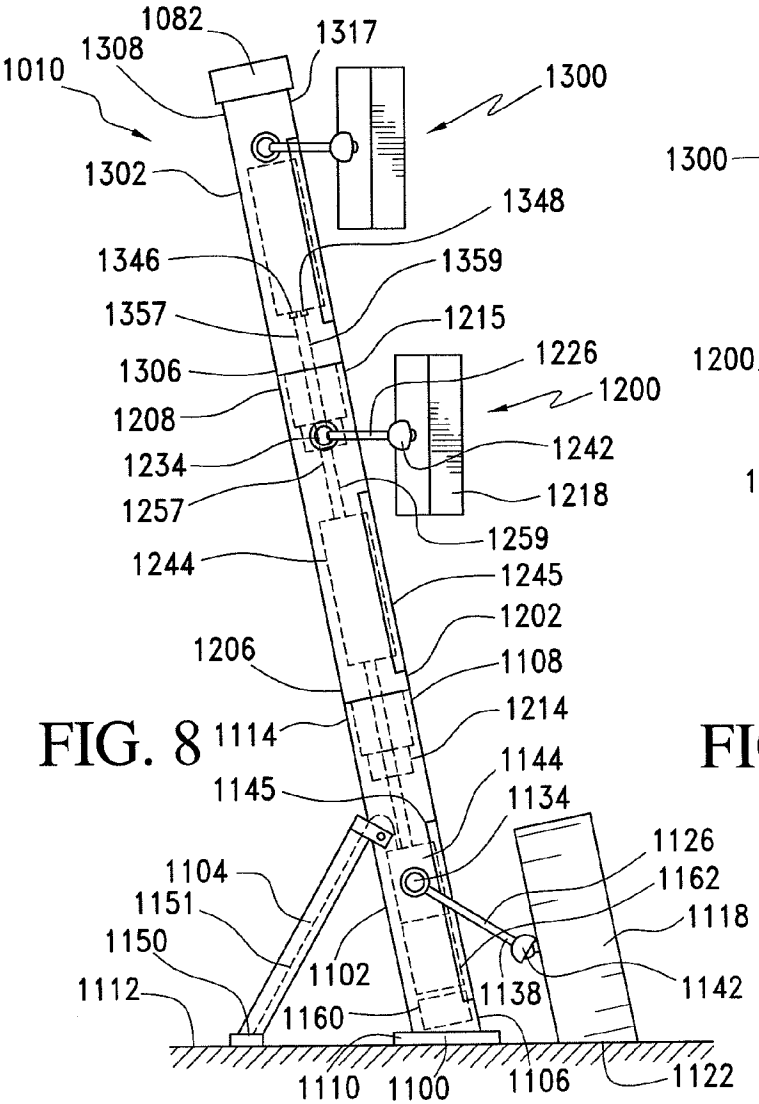

As shown in accordance with the embodiment disclosed with reference to FIG. 9, the modular speaker system 1010 is provided with a second auxiliary speaker assembly 1300. As with the other auxiliary speaker assembly discussed above, this auxiliary speaker assembly includes a longitudinally extending, auxiliary support member 1302 having a first end 1306 a second end 1308. The first end 1306 includes a male coupling member 1315 shaped and dimensioned for selective engagement with the female coupling member 1215 at the second end 1208 of the auxiliary support member 1202. The male coupling member 1315 at the first end 1306 of the auxiliary support member 1302 is a male coupling member shaped and dimensioned for receipt within the female coupling member 1215 at the second end 1208 of the auxiliary support member 1202 of the auxiliary speaker assembly 1200. The second end 1308 of the auxiliary support member 1302 includes a coupling member 1317 shaped and dimensioned to selectively receive and support an additional auxiliary speaker assembly.

The auxiliary speaker assembly 1300 includes a first support arm 1324 connecting a first driver 1316 to the auxiliary support member 1202 and a second support arm 1326 connecting a second driver 1318 to the auxiliary support member 1202. Each of the first and second support arms 1324, 1326 includes a first and a second end. The first ends 1328, 1330 of the first and second support arms 1324, 1326 are coupled to the auxiliary support member 1202 via a swivel joint 1332, 1334 allowing free movement therebetween and the second ends 1336, 1338 of the first and second support arms 1324, 1326 are similarly coupled to the respective first and second driver assemblies (for example, and in accordance with a preferred embodiment, which is composed of a midrange driver and tweeter, or high frequency driver (not shown)) 1316, 1318 via a swivel joint 1340, 1342 allowing free movement therebetween.

An auxiliary member amplifier 1344 drives the first and second driver assemblies 1316, 1318. This auxiliary member amplifier 1344 is substantially similar to the one discussed above. As such, the auxiliary member amplifier 1344 is mounted within the auxiliary support member 1302 and is covered by a removable plate 1347 for ready access to various control members/source inputs 1349 along the auxiliary member amplifier 1344 by a user of the present modular speaker system 1010. The auxiliary member amplifier 1344 includes a source connection 1346 and a power connection 1248. The source connection 1246 and power connection 1248 are linked to the auxiliary member amplifier 1244 (and ultimately the digital signal processor 1162) via output wires 1257, 1259 of the auxiliary member amplifier 1244 providing a power and source output from the auxiliary member amplifier 1244. While the relay of digital signal processor signals and power is contemplated in accordance with a disclosed embodiment, it is appreciated the digital signal processor could be directly wired for connection to the auxiliary member amplifier. The transmitting of source signals and power is achieved by extending input wires 1357, 1359 from the source connection 1346 and the power connection 1348 of the auxiliary member amplifier 1344 to the first end 1306 of the auxiliary support member 1302. The input wires are provided with terminal connections (not shown) shaped and dimensioned for selective coupling with the output wires 1257, 1259 extending from the digital signal processor to the second end 1208 of the central support member 1202. As with the input wires 1357, 1359 of the auxiliary member amplifier 1244, the output wires of the auxiliary member amplifier 1244 are provided with mating terminal connections (not shown) shaped and dimensioned for selective coupling with the terminal connections 1352, 1354 of the input wires of the auxiliary member amplifier 1344.

The ability of the auxiliary member amplifier 1244 to relay signals and power from the digital signal processor 1162 to the auxiliary member amplifier 1344 is achieved by providing the auxiliary member amplifier 1244 with a microprocessor 1270 controlling the functioning of the auxiliary member amplifier 1244 and allowing it to function as a "smart" amplifier.

In addition, cooling of the present modular speaker system 1010 is enhanced by the inclusion of fan 1082 integrated into a removable cap of for placement upon the top auxiliary speaker assembly (in accordance with the disclosed embodiment, auxiliary speaker assembly 1300). The fan 1082 is oriented to draw air from the internal cavity defined by the base assembly and the auxiliary speaker assembly(ies), creating a constant, cooling airflow within the present modular speaker system 1010. Ease of construction and assembly is achieved by making the base support member 1102 and the auxiliary support members 1202, 1302 with the same diameter. This will allow for the use of similar materials during construction, and permit versatility in the order in which various auxiliary speaker assemblies are coupled together.

It is further appreciated the additional "slave" units may be provided for utilization in conjunction with the first and second modular speaker systems disclosed above. Such "slave" units would be constructed without signal processors, but would include amplifiers and transceivers. Consequently, these "slave" units would operate based upon instructions received from the first and/or second modular speaker systems.

It is also appreciated the first and/or second modular speaker systems may be modified with different types of sound enhancing modules—made to conform to the physical/electrical constraints of our preferred embodiment.

Although various preferred shapes are disclosed in accordance with a preferred embodiment, for example, cylindrical shaped support members, those skilled in the art will appreciate that various shapes may be employed without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A modular speaker system, comprising:

a base assembly including a longitudinally extending, central support member, the central support member includes a first end and a second end;

a first base driver secured to the base assembly;

a base assembly amplifier mounted within the central support member and connected to the first base driver;

an auxiliary speaker assembly including a longitudinally extending, auxiliary support member having a first end and a second end, the first end being shaped and dimensioned for selective engagement with the second end of the central support member;

a first driver secured to the auxiliary speaker assembly; and an amplifier mounted within the auxiliary support member and the amplifier is connected to the first driver; and wherein the first driver is secured to the auxiliary speaker assembly via a first coupling arm extending between the auxiliary support member and the first driver.

2. The speaker system according to claim 1, wherein the first end of the central support member is provided with a planar support member shaped and dimensioned to sit upon a support surface in a manner supporting the base assembly in a stable manner when used in conjunction with a support leg.

3. The speaker system according to claim 1, wherein the second end of the central support member includes a coupling member shaped and dimensioned to selectively receive and support the auxiliary speaker assembly.

4. The speaker system according to claim 1, further including a second base driver secured to the base assembly.

5. The speaker system according to claim 1, wherein the first base driver includes a base shaped and dimensioned to sit up a support surface in a stable manner.

6. The speaker system according to claim 1, wherein the first base driver is secured to the base assembly via a first coupling arm extending between the central support member and the first base driver.

7. The speaker system according to claim 1, wherein the amplifier includes a source connection and a power connection, the source connection and power connection being linked to an external connection point for connection to a remote source and a remote power source.

8. The speaker system according to claim 1, wherein the first end of the auxiliary support member includes a coupling member shaped and dimensioned for selective engagement with a coupling member at the second end of the central support member.

9. The speaker system according to claim 1, further including a second driver secured to the auxiliary speaker assembly.

10. The speaker system according to claim 1, wherein the auxiliary amplifier includes a source connection and a power connection, the source connection and power connection being linked to an external connection point for connection to a remote source and a remote power source.

11. The speaker system according to claim 1, further including a second auxiliary speaker assembly secured to the auxiliary speaker assembly.

12. The speaker system according to claim 1, wherein the base member amplifier is mounted within the central support member and is covered by a plate for ready access by a user of the present speaker assembly.

13. The speaker system according to claim 1, further including a light source synchronizable with a music source.

14. The speaker system according to claim 1, further including a digital signal processor connected to the base amplifier.

15. The speaker system according to claim 14, further including a wireless transceiver connected to the digital signal processor and the base amplifier.

16. The speaker system according to claim 1, further including a wireless transceiver connected to the base amplifier.

17. A sound assembly, comprising:

a first modular speaker system including a base assembly, a first base driver secured to the base assembly, a base assembly amplifier, a digital signal processor and a wireless transceiver mounted within the base assembly and connected to the first base driver, an auxiliary speaker assembly shaped and dimensioned for selective engagement with the base assembly, a first driver secured to the auxiliary speaker assembly; and an amplifier mounted within the auxiliary support member and the amplifier is connected to the first driver; and a second modular speaker system including a base assembly, a first base driver secured to the base assembly, a base assembly amplifier, a digital signal processor and a wireless transceiver mounted within the base assembly and connected to the first base driver, an auxiliary speaker assembly shaped and dimensioned for selective engagement with the base assembly, a first driver secured to the auxiliary speaker assembly; and an amplifier mounted within the auxiliary support member and the amplifier is connected to the first driver.

18. The sound assembly according to claim 17, wherein the base assembly of the first modular speaker system includes a longitudinally extending, central support member, the central support member includes a first end a second end, and the base assembly of the second modular speaker system includes a longitudinally extending, central support member, the central support member includes a first end and a second end.

19. The sound assembly according to claim 18, wherein the auxiliary speaker assembly of the first modular speaker system includes a longitudinally extending, auxiliary support member having a first end a second end, the first end being shaped and dimensioned for selective engagement with the second end of the central support member of the first modular speaker system, and the auxiliary speaker assembly of the second modular speaker system includes a longitudinally extending, auxiliary support member having a first end and a second end, the first end being shaped and dimensioned for selective engagement with the second end of the central support member of the second modular speaker system.

* * * * *